US009892742B2

(12) United States Patent
Vasilache et al.

(10) Patent No.: US 9,892,742 B2
(45) Date of Patent: Feb. 13, 2018

(54) AUDIO SIGNAL LATTICE VECTOR QUANTIZER

(71) Applicant: Nokia Technologies Oy, Espoo (FI)

(72) Inventors: Adriana Vasilache, Tampere (FI); Anssi Sakari Rämö, Tampere (FI); Lasse Juhani Laaksonen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 2 days.

(21) Appl. No.: 15/102,855

(22) PCT Filed: Dec. 17, 2013

(86) PCT No.: PCT/IB2013/061034
§ 371 (c)(1),
(2) Date: Jun. 8, 2016

(87) PCT Pub. No.: WO2015/092483
PCT Pub. Date: Jun. 25, 2015

(65) Prior Publication Data

US 2016/0314797 A1 Oct. 27, 2016

(51) Int. Cl.
*G10L 19/12* (2013.01)
*G10L 19/038* (2013.01)
*G10L 19/07* (2013.01)

(52) U.S. Cl.
CPC ..... *G10L 19/038* (2013.01); *G10L 19/07* (2013.01)

(58) Field of Classification Search
CPC ..... G10L 19/038; G10L 19/07
See application file for complete search history.

(56) References Cited

U.S. PATENT DOCUMENTS

2005/0285764 A1 12/2005 Bessette et al.
2008/0294429 A1* 11/2008 Su ..... G10L 19/09 704/222

(Continued)

FOREIGN PATENT DOCUMENTS

RU 2486609 C2 6/2013
WO 2005083889 9/2005

(Continued)

OTHER PUBLICATIONS

International Search Report and Written Opinion received for corresponding Patent Cooperation Treaty Application No. PCT/IB2013/061034, dated Sep. 11, 2014, 12 pages.

(Continued)

*Primary Examiner* — Qian Yang
(74) *Attorney, Agent, or Firm* — Alston & Bird LLP

(57) ABSTRACT

An apparatus comprising: a vector generator configured to generate at least one vector of parameters defining at least one audio signal; a lattice vector quantizer configured to sort the at least one vector of parameters according to an ordering of at least one vector absolute tuples to generate an associated at least one ordered vector of parameters; the lattice vector quantizer configured to select from a list of leader classes at least one potential code vector; the lattice vector quantizer configured to determine a distance between the at least one potential code vector and the at least one ordered vector of parameters; the lattice vector quantizer configured to determine at least one leader class associated with a potential code vector which generates the smallest associated distance; the lattice vector quantizer configured to transpose the at least one leader class to generate an output lattice quantized codevector.

15 Claims, 5 Drawing Sheets

(56) References Cited

U.S. PATENT DOCUMENTS

| | | | | |
|---|---|---|---|---|
| 2009/0175550 | A1 | 7/2009 | Taleb | |
| 2010/0274556 | A1 | 10/2010 | Sato et al. | |
| 2011/0125495 | A1 | 5/2011 | Morii et al. | |
| 2011/0137645 | A1 | 6/2011 | Vary et al. | |
| 2014/0153625 | A1* | 6/2014 | Vojcic | H04L 1/005 375/224 |
| 2015/0287418 | A1 | 10/2015 | Vasilache et al. | |

FOREIGN PATENT DOCUMENTS

| | | | |
|---|---|---|---|
| WO | WO 2009/090875 | A1 | 7/2009 |
| WO | 2009127097 | | 10/2009 |
| WO | 2012069886 | | 5/2012 |
| WO | 2013005065 | | 1/2013 |
| WO | 2014/068167 | A1 | 5/2014 |

OTHER PUBLICATIONS

Vasilache A. Tabus I, "Indexing and entropy coding of lattice codevectors", 2001 IEEE International Conference on Acoustics, Speech, and Signaling Processing, Proceedings (ICASSP), Salt Lake City, UT, May 7-11, 2001, IEEE International Conference on Acoustics, Speech and Signal Processing (ICASSP), May 7, 2001, May 7, 2001-May 11, 2001, New York, NT: IEEE, US ISBN 978-0-7803-7041-8.

Nikaneshan S. et al. "Efficient methods for the addressing/decoding of a lattice-based fixed rate, entropy-coded vector quantizer", Communications, 1997. IC'97 Montreal, Towards the Knowledge Millenni um. 1997 IEEE International Conference on Montreal, Que., Canada Jun. 8-12, 1997, Jun. 8, 1997, Jun. 12, 1997, New York NY, USA, IEEE, US ISBN 978-0-7803-3925-5; ISBN 978-0-7803-3925-8.

Vasilache et al., "Multiple-Scale Leader-Lattice VQ With Application to LSF Quantization", Signal Processing, vol. 82, No. 4, Apr. 2002, pp. 563-586.

Extended European Search Report received for corresponding European Patent Application No. 13899497.5, dated May 4, 2017, 6 pages.

Office action received for corresponding Korean Patent Application No. 2016-7019246, dated Jun. 29, 2017, 7 pages of office action and no pages of office action translation available.

Office Action from Russian Patent Application No. 2016125708, dated Dec. 12, 2017, 8 pages.

* cited by examiner

AUDIO SIGNAL LATTICE VECTOR QUANTIZER

RELATED APPLICATION

This application was originally filed as PCT Application No. PCT/IB2013/061034 filed Dec. 17, 2013.

FIELD

The present application relates to a multichannel or stereo audio signal encoder, and in particular, but not exclusively to a multichannel or stereo audio signal encoder for use in portable apparatus.

BACKGROUND

Audio signals, like speech or music, are encoded for example to enable efficient transmission or storage of the audio signals.

Audio encoders and decoders (also known as codecs) are used to represent audio based signals, such as music and ambient sounds (which in speech coding terms can be called background noise). These types of coders typically do not utilise a speech model for the coding process, rather they use processes for representing all types of audio signals, including speech. Speech encoders and decoders (codecs) can be considered to be audio codecs which are optimised for speech signals, and can operate at either a fixed or variable bit rate.

Audio encoders and decoder are often designed as low complexity source coders. In other words able to perform encoding and decoding of audio signals without requiring highly complex processing.

An example of which is transform coding. For music signal audio encoding transform coding generally performs better than Algebraic Code Excited Linear Prediction (ACELP) technology which is better suited and directed for speech signals. Transform coding is performed by coding transform coefficients vector sub-band wise. In other words an audio signal is divided into sub-bands for which a parameter is determined and the parameters represent sub-vectors which are vector or lattice quantised.

SUMMARY

According to a first aspect there is provided a method comprising: generating at least one vector of parameters defining at least one audio signal; sorting the at least one vector of parameters according to an ordering of at least one vector absolute tuples to generate an associated at least one ordered vector of parameters; selecting from a list of leader classes at least one potential code vector; determining a distance between the at least one potential code vector and the at least one ordered vector of parameters; determining at least one leader class associated with a potential code vector which generates the smallest associated distance; transposing the at least one leader class to generate an output lattice quantized codevector.

The method may further comprise: selecting at least one scale factor; determining a distance between the at least one potential code vector and the at least one ordered vector of parameters may further comprise determining a distance based on the at least one scale factor; determining at least one leader class associated with a potential code vector which generates the smallest associated distance may further comprise determining an output scale factor associated with a potential code vector and scale factor which generates the smallest associated distance; transposing the at least one leader class to generate an output lattice quantized codevector may comprise applying the output scale factor to the output lattice quantized codevector.

Generating a first vector of parameters defining at least one audio signal may comprise: dividing the at least one audio signal into time frames; determining a vector of line spectral frequency parameters associated with the at least one audio signal time frames.

Sorting the at least one vector of parameters according to an ordering of at least one vector absolute tuples to generate an associated at least one ordered vector of parameters may comprise: determining weights for a weighted distance determination; sorting the weights based on the ordering of the at least one vector absolute tuples to generate a sorted weight vector; applying the sorted weight vector to the at least one ordered vector of parameters.

Determining a distance between the at least one potential code vector and the at least one ordered vector of parameters may comprise: generating a first and second distance components based on a first scale value, the first and second distance components associated with the distance between the at least one potential code vector and the at least one ordered vector of parameters; correcting the sign of the first distance component where the potential code vector fails a parity constraint test; determining a distance between the at least one potential code vector and the at least one ordered vector of parameters based on the first and second distance components.

Determining a distance between the at least one potential code vector and the at least one ordered vector of parameters may further comprise determining a distance between the at least one potential code vector and the at least one ordered vector of parameters based on the first and second distance components and further scale values.

Determining at least one leader class associated with a potential code vector which generates the smallest associated distance may comprise: determining the index of the potential code vector which generates the smallest associated distance; determining the scale value of the potential code vector which generates the smallest associated distance by applying scale values to only the potential code vector which generates the smallest associated distance.

Transposing the at least one leader class to generate an output lattice quantized codevector may comprise sorting the at least one leader class by the reverse ordering of at least one vector absolute tuples.

According to a second aspect there is provided an apparatus comprising: means for generating at least one vector of parameters defining at least one audio signal; means for sorting the at least one vector of parameters according to an ordering of at least one vector absolute tuples to generate an associated at least one ordered vector of parameters; means for selecting from a list of leader classes at least one potential code vector; means for determining a distance between the at least one potential code vector and the at least one ordered vector of parameters; means for determining at least one leader class associated with a potential code vector which generates the smallest associated distance; means for transposing the at least one leader class to generate an output lattice quantized codevector.

The apparatus may further comprise: means for selecting at least one scale factor; wherein the means for determining a distance between the at least one potential code vector and the at least one ordered vector of parameters may further comprise means for determining a distance based on the at least one scale factor; the means for determining at least one leader class associated with a potential code vector which generates the smallest associated distance may further comprise means for determining an output scale factor associated with a potential code vector and scale factor which generates the smallest associated distance; the means for transposing the at least one leader class to generate an output lattice quantized codevector may comprise means for applying the output scale factor to the output lattice quantized codevector.

The means for generating a first vector of parameters defining at least one audio signal may comprise: means for dividing the at least one audio signal into time frames; means for determining a vector of line spectral frequency parameters associated with the at least one audio signal time frames.

The means for sorting the at least one vector of parameters according to an ordering of at least one vector absolute tuples to generate an associated at least one ordered vector of parameters may comprise: means for determining weights for a weighted distance determination; means for sorting the weights based on the ordering of the at least one vector absolute tuples to generate a sorted weight vector; means for applying the sorted weight vector to the at least one ordered vector of parameters.

The means for determining a distance between the at least one potential code vector and the at least one ordered vector of parameters may comprise: means for generating a first and second distance components based on a first scale value, the first and second distance components associated with the distance between the at least one potential code vector and the at least one ordered vector of parameters; means for correcting the sign of the first distance component where the potential code vector fails a parity constraint test; means for determining a distance between the at least one potential code vector and the at least one ordered vector of parameters based on the first and second distance components.

The means for determining a distance between the at least one potential code vector and the at least one ordered vector of parameters may further comprise means for determining a distance between the at least one potential code vector and the at least one ordered vector of parameters based on the first and second distance components and further scale values.

The means for determining at least one leader class associated with a potential code vector which generates the smallest associated distance may comprise: means for determining the index of the potential code vector which generates the smallest associated distance; means for determining the scale value of the potential code vector which generates the smallest associated distance by applying scale values to only the potential code vector which generates the smallest associated distance.

The means for transposing the at least one leader class to generate an output lattice quantized codevector may comprise means for sorting the at least one leader class by the reverse ordering of at least one vector absolute tuples.

According to a third aspect there is provided an apparatus comprising at least one processor and at least one memory including computer program code, the at least one memory and the computer program code configured to, with the at least one processor, cause the apparatus at least to: generate at least one vector of parameters defining at least one audio signal; sort the at least one vector of parameters according to an ordering of at least one vector absolute tuples to generate an associated at least one ordered vector of parameters; select from a list of leader classes at least one potential code vector; determine a distance between the at least one potential code vector and the at least one ordered vector of parameters; determine at least one leader class associated with a potential code vector which generates the smallest associated distance; transpose the at least one leader class to generate an output lattice quantized codevector.

The apparatus may be further caused to: select at least one scale factor; wherein determining a distance between the at least one potential code vector and the at least one ordered vector of parameters may further cause the apparatus to determine a distance based on the at least one scale factor; wherein determining at least one leader class associated with a potential code vector which generates the smallest associated distance may further cause the apparatus to determine an output scale factor associated with a potential code vector and scale factor which generates the smallest associated distance; wherein transposing the at least one leader class to generate an output lattice quantized codevector may cause the apparatus to apply the output scale factor to the output lattice quantized codevector.

Generating a first vector of parameters defining at least one audio signal may cause the apparatus to: divide the at least one audio signal into time frames; determine a vector of line spectral frequency parameters associated with the at least one audio signal time frames.

Sorting the at least one vector of parameters according to an ordering of at least one vector absolute tuples to generate an associated at least one ordered vector of parameters may cause the apparatus to: determine weights for a weighted distance determination; sort the weights based on the ordering of the at least one vector absolute tuples to generate a sorted weight vector; apply the sorted weight vector to the at least one ordered vector of parameters.

Determining a distance between the at least one potential code vector and the at least one ordered vector of parameters may cause the apparatus to: generate a first and second distance components based on a first scale value, the first and second distance components associated with the distance between the at least one potential code vector and the at least one ordered vector of parameters; correct the sign of the first distance component where the potential code vector falls a parity constraint test; determine a distance between the at least one potential code vector and the at least one ordered vector of parameters based on the first and second distance components.

Determining a distance between the at least one potential code vector and the at least one ordered vector of parameters may further cause the apparatus to determine a distance between the at least one potential code vector and the at least one ordered vector of parameters based on the first and second distance components and further scale values.

Determining at least one leader class associated with a potential code vector which generates the smallest associated distance may cause the apparatus to: determine the index of the potential code vector which generates the smallest associated distance; determine the scale value of the potential code vector which generates the smallest associated distance by applying scale values to only the potential code vector which generates the smallest associated distance.

Transposing the at least one leader class to generate an output lattice quantized codevector may cause the apparatus to sort the at least one leader class by the reverse ordering of at least one vector absolute tuples.

According to a fourth aspect there is provided an apparatus comprising: a vector generator configured to generate at least one vector of parameters defining at least one audio signal; a lattice vector quantizer configured to sort the at least one vector of parameters according to an ordering of at least one vector absolute tuples to generate an associated at least one ordered vector of parameters; the lattice vector quantizer configured to select from a list of leader classes at least one potential code vector; the lattice vector quantizer configured to determine a distance between the at least one potential code vector and the at least one ordered vector of parameters; the lattice vector quantizer configured to determine at least one leader class associated with a potential code vector which generates the smallest associated distance; the lattice vector quantizer configured to transpose the at least one leader class to generate an output lattice quantized codevector.

The apparatus may further comprise: the lattice vector quantizer configured to select at least one scale factor; wherein the lattice vector quantizer configured to determining a distance between the at least one potential code vector and the at least one ordered vector of parameters further may be configured to determine a distance based on the at least one scale factor; the lattice vector quantizer configured to determine at least one leader class associated with a potential code vector which generates the smallest associated distance may be further configured to determine an output scale factor associated with a potential code vector and scale factor which generates the smallest associated distance; the lattice vector quantizer configured to transpose the at least one leader class to generate an output lattice quantized codevector may be further configured to apply the output scale factor to the output lattice quantized codevector.

The apparatus may further comprise a parameter determiner configured to divide the at least one audio signal into time frames; and determine a vector of line spectral frequency parameters associated with the at least one audio signal time frames.

Wherein the lattice vector quantizer configured to sort the at least one vector of parameters according to an ordering of at least one vector absolute tuples to generate an associated at least one ordered vector of parameters may be further configured to: determine weights for a weighted distance determination; sort the weights based on the ordering of the at least one vector absolute tuples to generate a sorted weight vector, apply the sorted weight vector to the at least one ordered vector of parameters.

The lattice vector quantizer configured to determine a distance between the at least one potential code vector and the at least one ordered vector of parameters may be further configured to: generate a first and second distance components based on a first scale value, the first and second distance components associated with the distance between the at least one potential code vector and the at least one ordered vector of parameters; correct the sign of the first distance component where the potential code vector fails a parity constraint test; determine a distance between the at least one potential code vector and the at least one ordered vector of parameters based on the first and second distance components.

The lattice vector quantizer configured to determine a distance between the at least one potential code vector and the at least one ordered vector of parameters further may be configured to determine a distance between the at least one potential code vector and the at least one ordered vector of parameters based on the first and second distance components and further scale values.

The lattice vector quantizer configured to determine at least one leader class associated with a potential code vector which generates the smallest associated distance may be further configured to: determine the index of the potential code vector which generates the smallest associated distance; determine the scale value of the potential code vector which generates the smallest associated distance by applying scale values to only the potential code vector which generates the smallest associated distance.

The lattice vector quantizer configured to transpose the at least one leader class to generate an output lattice quantized codevector may be configured to sort the at least one leader class by the reverse ordering of at least one vector absolute tuples.

A computer program product may cause an apparatus to perform the method as described herein.

An electronic device may comprise apparatus as described herein.

A chipset may comprise apparatus as described herein.

BRIEF DESCRIPTION OF DRAWINGS

For better understanding of the present invention, reference will now be made by way of example to the accompanying drawings in which.

DESCRIPTION OF SOME EMBODIMENTS OF THE APPLICATION

The following describes in more detail possible stereo and multichannel speech and audio codecs, including layered or scalable variable rate speech and audio codecs.

There can be a problem with current transform coding approaches in that the use of compression efficient lattices can improve significantly the quantisation. However they manage to produce such improvements at the cost of significant codec complexity.

The concept as discussed in detail by the embodiments herein propose an approach allowing for significant encoding complexity reduction by evaluating the quantization distortion in a transposed vector space.

Figure 1:
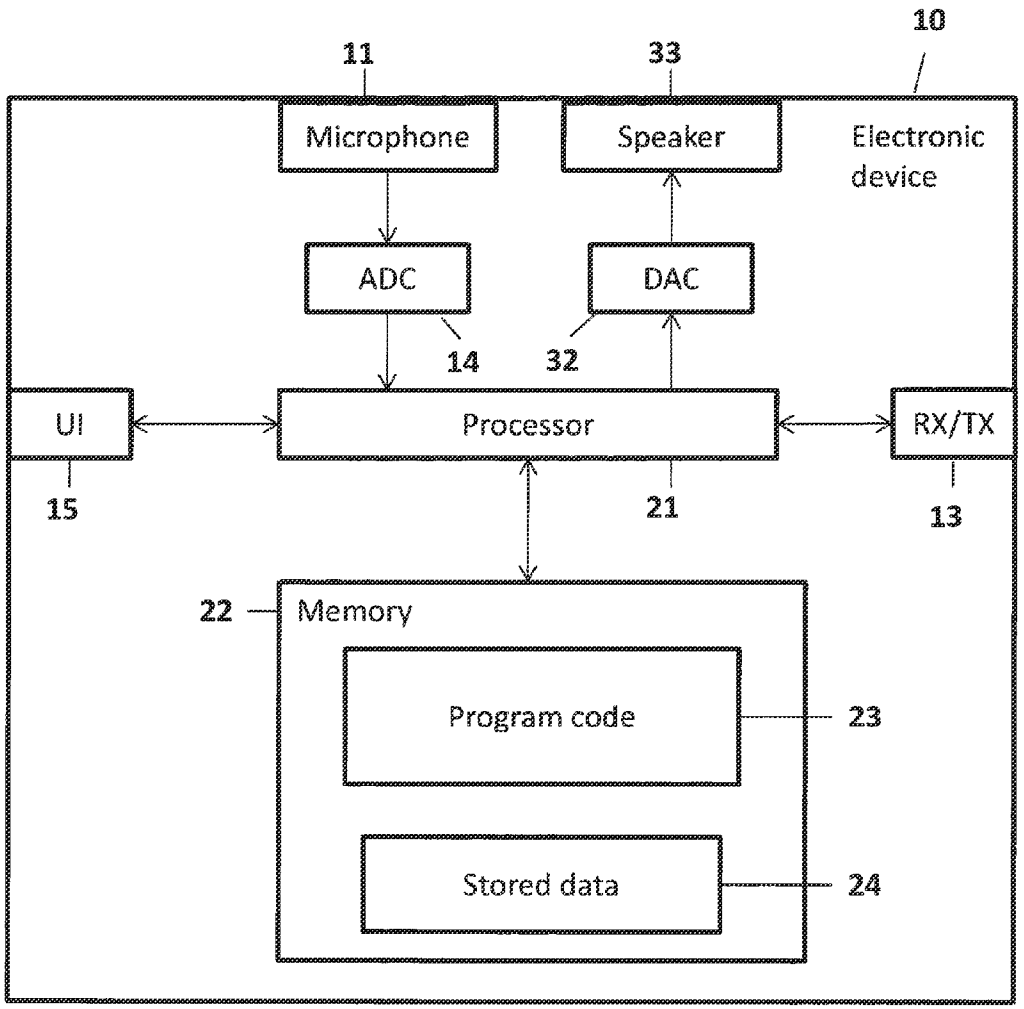
FIG. 1 shows schematically an electronic device employing some embodiments.

In this regard reference is first made to FIG. 1 which shows a schematic block diagram of an exemplary electronic device or apparatus 10, which may incorporate a codec according to an embodiment of the application.

The apparatus 10 may for example be a mobile terminal or user equipment of a wireless communication system. In other embodiments the apparatus 10 may be an audio-video device such as video camera, a Television (TV) receiver, audio recorder or audio player such as a mp3 recorder/player, a media recorder (also known as a mp4 recorder/player), or any computer suitable for the processing of audio signals.

The electronic device or apparatus 10 in some embodiments comprises a microphone 11, which is linked via an analogue-to-digital converter (ADC) 14 to a processor 21.

The processor 21 is further linked via a digital-to-analogue (DAC) converter 32 to loudspeakers 33. The processor 21 is further linked to a transceiver (RX/TX) 13, to a user interface (UI) 15 and to a memory 22.

The processor 21 can in some embodiments be configured to execute various program codes. The implemented program codes in some embodiments comprise an audio encoding or decoding code as described herein. The implemented program codes 23 can in some embodiments be stored for example in the memory 22 for retrieval by the processor 21 whenever needed. The memory 22 could further provide a section 24 for storing data, for example data that has been encoded in accordance with the application.

The encoding and decoding code in embodiments can be implemented at least partially in hardware and/or firmware.

The user interface (UI) 15 enables a user to input commands to the electronic device 10, for example via a keypad, and/or to obtain information from the electronic device 10, for example via a display. In some embodiments a touch screen may provide both input and output functions for the user interface. The apparatus 10 in some embodiments comprises a transceiver (RX/TX) 13 suitable for enabling communication with other apparatus, for example via a wireless communication network.

The transceiver 13 can communicate with further devices by any suitable known communications protocol, for example in some embodiments the transceiver 13 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

It is to be understood again that the structure of the apparatus 10 could be supplemented and varied in many ways.

A user of the apparatus 10 for example can use the microphone 11 for inputting speech or other audio signals that are to be transmitted to some other apparatus or that are to be stored in the data section 24 of the memory 22. A corresponding application in some embodiments can be activated to this end by the user via the user interface 15. This application in these embodiments can be performed by the processor 21, causes the processor 21 to execute the encoding code stored in the memory 22. Although in the following examples the microphone 11 is configured to generate the audio signals for inputting it would be understood that the Input audio signals can be received from any suitable input such as from the memory 22 and specifically within the stored data 24 section of the memory 22. In some embodiments the input audio signal or at least one audio signal can be received via the transceiver 13. For example the transceiver 13 can be configured to receive audio signals generated by microphones external to the apparatus 10, for example a Bluetooth device coupled to the apparatus via the transceiver 13.

The analogue-to-digital converter (ADC) 14 in some embodiments converts the Input analogue audio signal into a digital audio signal and provides the digital audio signal to the processor 21. In some embodiments the microphone 11 can comprise an Integrated microphone and ADC function and provide digital audio signals directly to the processor for processing.

The processor 21 in such embodiments then processes the digital audio signal in the same way as described with reference to the system shown in FIG. 2, and specifically the encoder shown in FIG. 3, and details of the encoder shown in FIG. 5.

The resulting bit stream can in some embodiments be provided to the transceiver 13 for transmission to another apparatus. Alternatively, the coded audio data in some embodiments can be stored in the data section 24 of the memory 22, for instance for a later transmission or for a later presentation by the same apparatus 10.

The apparatus 10 in some embodiments can also receive a bit stream with correspondingly encoded data from another apparatus via the transceiver 13. In this example, the processor 21 may execute the decoding program code stored in the memory 22. The processor 21 in such embodiments decodes the received data, and provides the decoded data to a digital-to-analogue converter 32. The digital-to-analogue converter 32 converts the digital decoded data into analogue audio data and can in some embodiments output the analogue audio via the loudspeakers 33. Execution of the decoding program code in some embodiments can be triggered as well by an application called by the user via the user interface 15.

The received encoded data in some embodiment can also be stored instead of an immediate presentation via the loudspeakers 33 in the data section 24 of the memory 22, for instance for later decoding and presentation or decoding and forwarding to still another apparatus.

Figure 3:
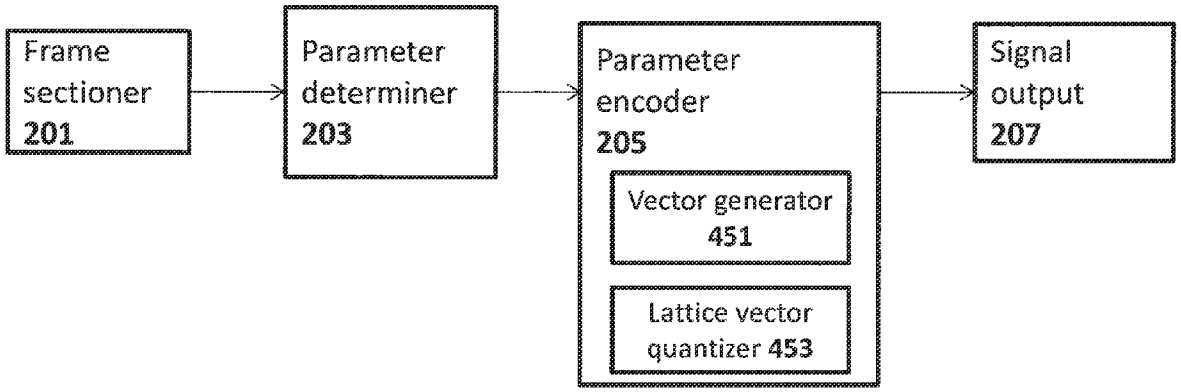
FIG. 3 shows schematically an encoder as shown in FIG. 2 according to some embodiments.
Figure 4:
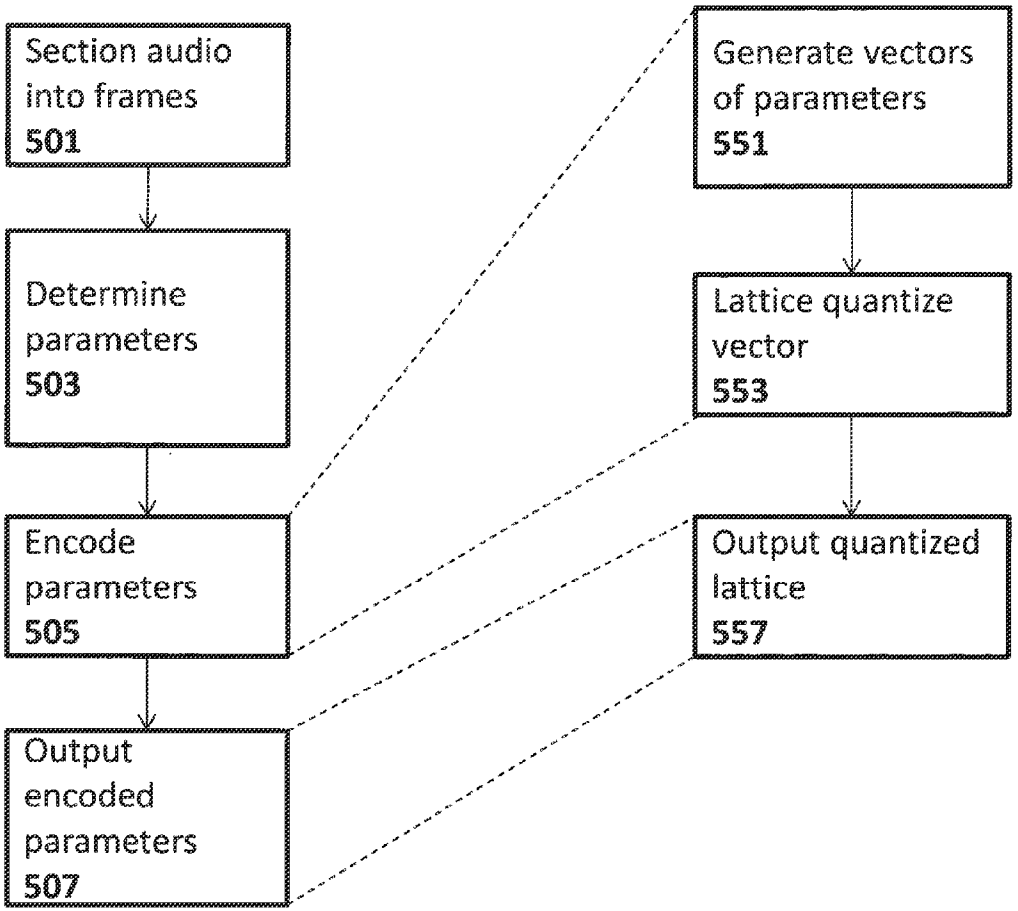
FIG. 4 shows a flow diagram illustrating the operation of the encoder shown in FIG. 3 according to some embodiments.
Figure 5:
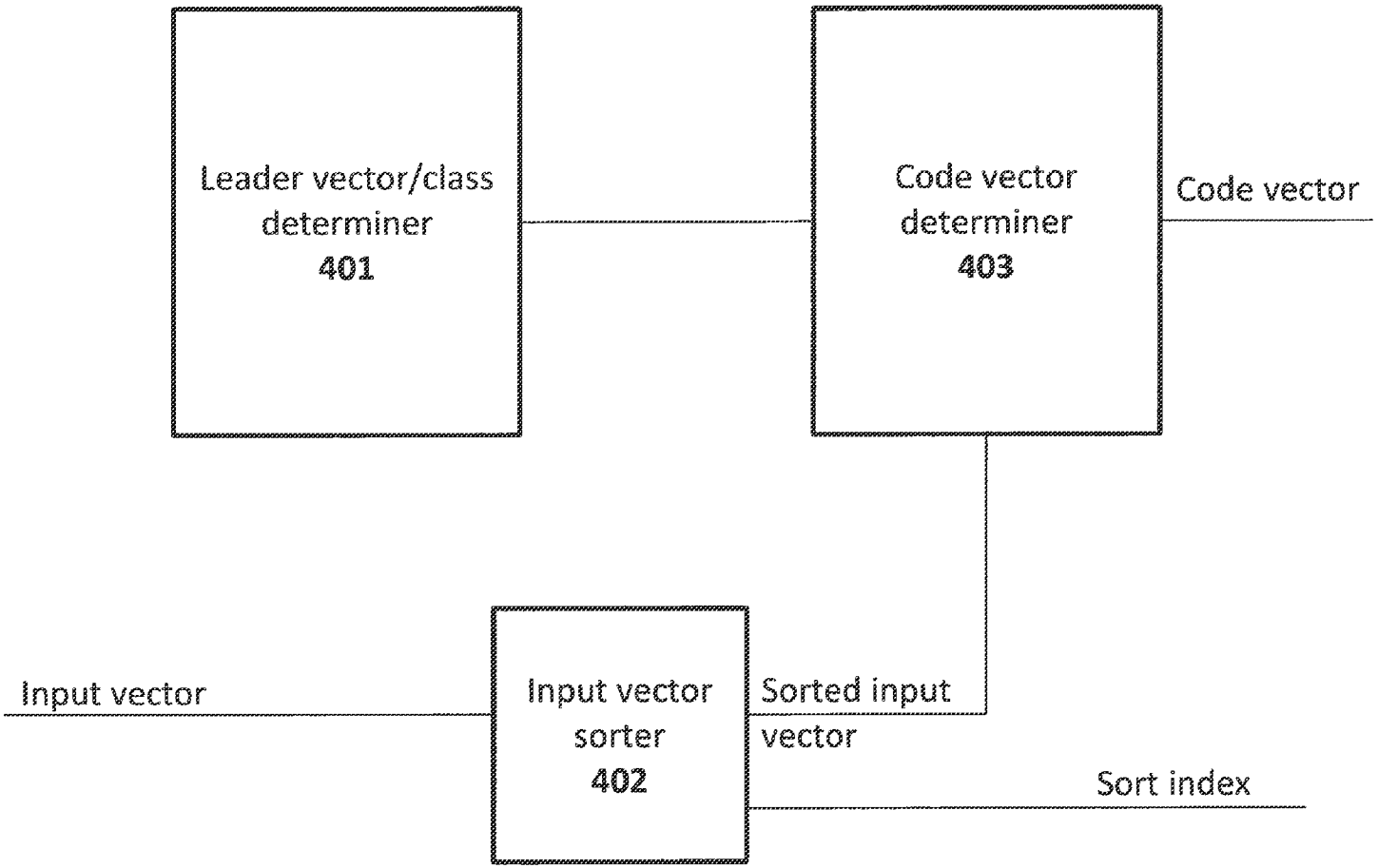
FIG. 5 shows schematically a lattice vector quantizer as shown in FIG. 3 according to some embodiments.
Figure 6:
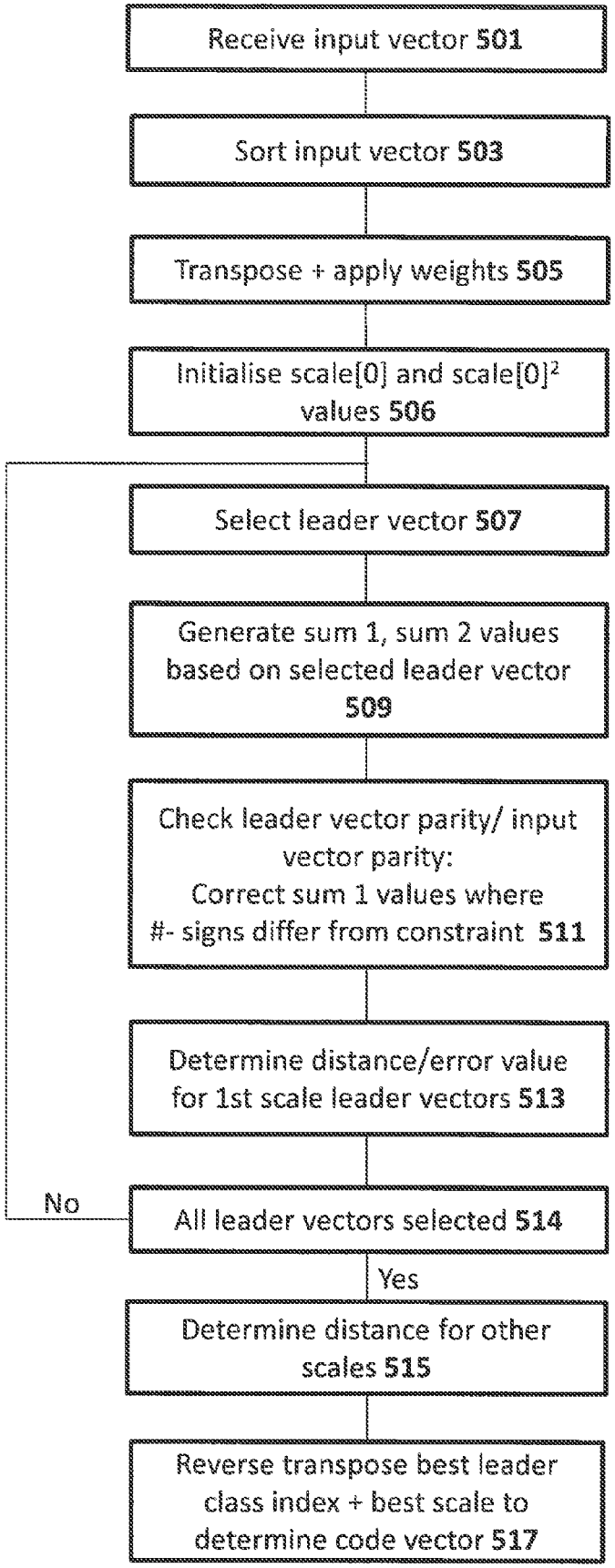
FIG. 6 shows a flow diagram illustrating the operation of the lattice vector quantizer shown in FIG. 5 according to some embodiments.

It would be appreciated that the schematic structures described in FIGS. 3 and 5 and the method steps shown in FIGS. 4 and 6 represent only a part of the operation of an audio codec and specifically part of an audio encoder apparatus or method as exemplarily shown implemented in the apparatus shown in FIG. 1.

Figure 2:
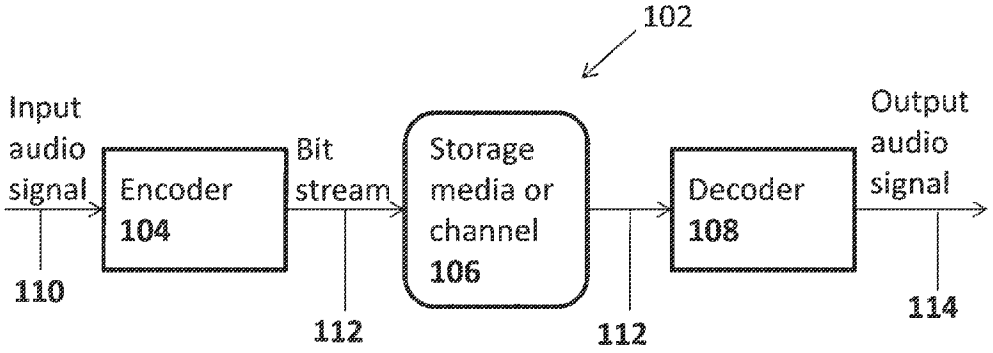
FIG. 2 shows schematically an audio codec system according to some embodiments.

The general operation of audio codecs as employed by embodiments is shown in FIG. 2. General audio coding/decoding systems comprise both an encoder and a decoder, as illustrated schematically in FIG. 2. However, it would be understood that some embodiments can implement one of either the encoder or decoder, or both the encoder and decoder. Illustrated by FIG. 2 is a system 102 with an encoder 104, a storage or media channel 106 and a decoder 108. It would be understood that as described above some embodiments can comprise or implement one of the encoder 104 or both the encoder 104 and decoder 108.

The encoder 104 compresses an input audio signal 110 producing a bit stream 112, which in some embodiments can be stored or transmitted through a media channel 106. The encoder 104 can in some embodiments comprise a multi-channel encoder that encodes two or more audio signals.

The bit stream 112 can be received within the decoder 108. The decoder 108 decompresses the bit stream 112 and produces an output audio signal 114. The decoder 108 can comprise a transform decoder as part of the overall decoding operation. The decoder 108 can also comprise a multi-channel decoder that decodes two or more audio signals. The bit rate of the bit stream 112 and the quality of the output audio signal 114 in relation to the input signal 110 are the main features which define the performance of the coding system 102.

FIG. 3 shows schematically the encoder 104 according to some embodiments.

FIG. 4 shows schematically in a flow diagram the operation of the encoder 104 according to some embodiments.

The concept for the embodiments as described herein is to determine and apply encoding to audio signals to produce efficient high quality and low bit rate real life coding. To that respect with respect to FIG. 3 an example encoder 104 is shown according to some embodiments. Furthermore with respect to FIG. 4 the operation of the encoder 104 is shown in further detail. In the following examples the encoder is configured to generate frequency domain parameters representing the audio signal and encode the generated frequency domain parameters using a suitable vector lattice quantization, however it would be understood that in some embodiments the parameters used in the lattice quantization as described herein can be any suitable parameters defining or representing the audio signals or other type of signals (for example image or, video).

The encoder 104 in some embodiments comprises a frame sectioner 201 or suitable means for sectioning the audio signal. The frame sectioner 201 is configured to receive the audio signals (for example a mono, left and right stereo or any multichannel audio representation) input audio signal and section or segment the audio signal data into sections or frames suitable for frequency or other domain transformation. The frame sectioner 201 in some embodiments can further be configured to window these frames or sections of audio signal data according to any suitable windowing function. For example the frame sectioner 201 can be configured in some embodiments to generate frames of 20 ms which overlap preceding and succeeding frames by 10 ms each.

The operation of generating audio frames is shown in FIG. 4 by step 501.

In some embodiments the audio frames can be passed to a parameter determiner 203.

In some embodiments the encoder comprises a parameter determiner 203 of suitable means for determining at least one parameter representing the input audio signal(s) or input audio signal frames. In the following examples the parameter is a line spectral frequency (LSF) parameter however it would be understood that in some embodiments any suitable parameter can be determined.

For example in some embodiments the parameter determiner comprises a transformer 203 or suitable means for transforming. The transformer 203 in some embodiments is configured to generate frequency domain (or other suitable domain) parameter representations of these audio signals. These frequency domain parameter representations can in some embodiments be passed to the parameter encoder 205.

In some embodiments the transformer 203 can be configured to perform any suitable time to frequency domain transformation on the audio signal data. For example the time to frequency domain transformation can be a discrete Fourier transform (DFT), Fast Fourier transform (FFT), modified discrete cosine transform (MDCT). In the following examples a Fast Fourier Transform (FFT) is used.

Furthermore the transformer can further be configured to generate separate frequency band domain parameter representations (sub-band parameter representations) of each input channel audio signal data. These bands can be arranged in any suitable manner. For example these bands can be linearly spaced, or be perceptual or psychoacoustically allocated. The parameters generated can be any suitable parameter.

The operation of determining or generating parameter representations is shown in FIG. 4 by step 503.

In some embodiments the representations, such as LSF parameters, are passed to a parameter encoder 205.

In some embodiments the encoder 104 can comprise a parameter encoder 205. The parameter encoder 205 can be configured to receive the parameter representations of the audio signal input, for example the determined LSF parameters. The parameter encoder 205 can furthermore in some embodiments be configured to use each of the LSF parameter values as a sub-vector and combine each sub-vector to create a vector to input into a vector quantizer. In other words the apparatus can comprise a vector generator configured to generate a first vector of parameters (or tuples of a first vector representing the parameters) defining at least one audio signal.

The output of the vector quantizer is in some embodiments the encoder and therefore the vector quantized audio signals output are the 'encoded' or parameter encoded representations of the audio signal.

The operation of encoding or vector quantizing the parameters is shown in FIG. 4 by step 505

In some embodiments the parameter encoder 205 comprises a vector generator 451. The vector generator 451 is configured to receive the LSF parameters and generate a N dimensional vector from these values.

The operation of generating vectors from the input parameters is shown in FIG. 4 by sub-step 551.

The generated vectors can in some embodiments be passed to the lattice vector quantizer 453.

In some embodiments the parameter encoder 205 comprises a lattice vector quantizer 453. The lattice vector quantizer 453 receives the input vector generated from the LSF parameters and generates a nearest neighbour or NN output which occurs within a defined lattice and thus can be decoded using a similar lattice at the decoder.

The operation of Lattice quantizing the vector is shown in FIG. 4 by sub-step 553.

The encoded signal can be output.

The operation of outputting the encoded signal is shown in FIG. 4 by step 507. This for the example can be an operation of outputting the quantized lattice vector as shown in FIG. 4 by sub-step 557.

With reference to FIG. 5 there is shown an example lattice vector quantizer 453 according to some embodiments. The lattice quantizer 453 can in some embodiments be defined by respective program code 23 of a computer program that is stored on a tangible storage medium memory 22.

Before introducing the concepts and embodiments with respect to the invention we shall initially discuss conventional lattice vector quantization. In some lattice quantizers an initial generating or determining a set of potential basis code vectors, wherein each determined potential basis code vector of this set of potential basis code vectors is associated with a potential basis code vector of a different set of basis code vectors is performed.

Each set of potential basis code vectors comprises at least one basis code vector. Since each set of basis code vectors is associated with at least one scale representative of a plurality of scale representatives, a code vector can be determined based on a basis code vector of a set of potential basis code vectors and a scale representative of the at least one scale representative associated with the set of potential basis code vectors. In other words the code vector may be represented based on a basis code vector scaled by the respective scale representative. For instance, the scale representative may represent a scale value, wherein a code vector may be determined based on a multiplication of a basis code vector and the respective scale value. Furthermore in some embodiments the codebook is obtained by applying a (signed) permutation of the basis vector.

For instance, at least one set of basis code vectors is associated with at least two scale representatives.

Accordingly, as an example, a codebook may comprise a set of code vectors comprising code vectors based on the plurality of sets of basis code vectors and based on the respective at least one scale value associated with a respective set of basis code vectors of the plurality of basis code vectors. This set of code vectors may comprise, for each basis code vector of each set of basis code vectors and for each of the at least one scale representative associated with a respective set of basis code vectors, a code vector based on the respective basis code vector scaled by the respective scale representative.

For instance, said sets of basis code vectors may represent leader classes, wherein each leader class comprises a different leader vector and permutations of said leader vector. Thus, said leader vector and the permutations of said leader vector may represent the basis code vectors of the respective set of basis code vectors.

The plurality of sets of basis code vectors may represent a subset of a second plurality of sets of basis code vectors. For instance, under the assumption that each set of basis code vector represents a leader class, the plurality of leader classes may represent a subset of a second plurality of leader classes. Thus, the plurality of leader classes may be considered as a truncated plurality of leader classes with respect to the second plurality of leader classes.

For instance, the respective potential basis code vector may be determined by determining the basis code vector of the at least one basis code vector of the respective set of basis code vector which is nearest to the input vector to be encoded. Any kind of suitable criterion may be used for finding the nearest basis code vector with respect to the input vector to be encoded.

As an example, a potential basis code vector may be determined based on a nearest basis code vector with respect to the absolute valued input vector and based on information of signs of the values of the input vector, wherein this information may comprise the sign of a respective position of respective values in the input vector and is used to assign signs to values of the determined potential basis code vector. Furthermore, as an example, the basis code vector which is nearest to the absolute valued input vector may be determined, wherein the absolute valued input vector comprises absolute values corresponding to the values of the input vector, wherein the potential basis code vector represents the determined nearest basis code vector, wherein the signs of the values of the potential basis code vector correspond to the signs of the values of the input vector at the same position in the vector, wherein this may hold if the parity of the basis code vectors of the set of basis code vectors is 0. As another example, if the parity of the basis code vectors of the set of basis code vectors is −1, the signs of the values of the potential basis code vector may be assigned corresponding to the signs of the values of the input vector at the same position in the vector, respectively, and if there are not an odd number of negative components, the value in the potential basis code vector having the lowest non-null absolute value may change its sign. Or, as another example, if the parity of the basis code vectors of the set of basis code vectors is +1, the signs of the values of the potential basis code vector may be assigned corresponding to the signs of the values of the input vector at the same position in the vector, respectively, and if there are not an even number of negative components, the value in the potential basis code vector having the lowest non-null absolute value may change its sign.

The code vector for encoding the input vector is then conventionally determined based on the set of determined potential code vectors, wherein said set of determined potential code vectors defines a subset of code vectors, said subset of code vectors comprising, for each determined potential basis code vector and each scale representative associated with the set of basis code vectors of the respective potential basis code vector, a code vector based on the respective potential basis code vector scaled by the respective scale representative.

Accordingly, the search for the code vector for encoding the input vector has been performed in the subset of code vectors defined by the determined potential code vectors and defined by the respective at least one scale representative associated with the set of basis code vectors of the respective determined potential code vector. Since this subset of code vectors may represent a subset of code vectors associated with the codebook, the number of code vectors of this subset of code vectors may be less than the number of code vectors of the set of code vectors.

As an example, each scale representative of the plurality of scale representatives may be associated with at least one set of code vectors, wherein each set of code vectors of said at least one set of code vectors associated with a respective scale representative is associated with a set of basis code vectors of the plurality of sets of basis code vectors such that each set of code vectors of said at least one set of code vectors associated with a respective scale representative comprises code vectors obtained by scaling the basis vectors of the associated respective set of basis vectors with the respective scale representative.

Accordingly, the code vectors of the at least one set of basis code vectors associated with a respective scale representative of the plurality of scale representatives can be determined based on scaling the basis code vectors of each set of basis code vectors associated with the scale representative with this scale representative.

For instance, in case said sets of basis code vectors represent leader classes, the at least one set of basis code vectors associated with a respective scale representative may be considered as a union of leader classes. It would be understood that usually the union of leader classes is independent of the scale. Thus, the codebook may comprise at last one union of leader classes, wherein each union of leader class is associated with one of at least one scale representatives and with at least one set of basis code vectors of the plurality of basis code vectors. As an example, the at least one scale representative may represent the plurality of scale representatives which may comprise at least two scale representatives.

Thus for example $b_x$, with $x \in \{0, 1, \ldots X-1\}$, represents a set of basis code vectors of the plurality of sets of basis code vectors, wherein X represents the number of sets of the plurality of sets of basis code vectors. Each set of basis code vectors is associated or comprises at least one basis code vector $b_{x,y}$, wherein $B_x$ represents the number of basis code vectors of a respective set of basis code vectors $b_x$, i.e. $y \in \{0, 1, \ldots B_x-1\}$ holds. For instance, the number $B_x$ of basis code vectors of a set of basis code vectors may be different for different sets of basis code vectors and/or it may be the same for at least two sets of basis code vectors.

In other words a leader vector is just one vector. Together with all the signed permutations of the leader vector then this set forms the leader vector's leader class (or as described herein the basis code vectors). When putting together several leader classes, a union of leader classes is formed. Then to this union/unions one or more scales can be attached.

Thus for example it may be possible to determine a code vector $c_{x,z,y}$ based on basis code vector $b_{x,y}$ and based on a scale representative $s_z$, wherein index z represents the Index of the respective scale representative of the plurality of scale representatives $s_0 \ldots s_{S-1}$, i.e. $z \in \{0, 1, \ldots S-1\}$ holds.

For instance, in case the values $b_{x,y,t}$ of the basis code vectors $b_{x,y}=[b_{x,y,0}, b_{x,y,1}, \ldots, b_{x,y,n-1}]$ represent absolute values, wherein $t\in\{0, 1, \ldots n-1\}$ holds and n represents the length of the respective basis code vector $b_{x,y}$, and if the absolute valued input vector is used for determining the potential code vector of a respective set of basis code vectors, the sign of each value $b_{x,y,t}$ at the (t+1)th position of the determined nearest basis code vector $b_{x,y}$ may be assigned based on the sign of the respective value $i_t$ at the (t+1)th position of the input vector i, before determining a code vector $c_{x,z,y}$ based on basis code vector $b_{x,y}$ and based on a scale representative $s_z$ is performed.

As an example, if $i=[i_0, i_1, \ldots, i_{n-1}]$ represents the input vector, the absolute valued input vector may be represented by $[|i_0|, |i_1|, \ldots, |i_{n-1}|]$. For instance, the sign of each value $b_{x,y,t}$ at the (t+1)th position of the determined nearest basis code vector $b_{x,y}$ may be assigned to the sign of the respective value $i_t$ at the (t+1)th position of the input vector, respectively, wherein this may hold if the parity of the basis code vectors $b_{x,y}$ of the set of basis code vectors $b_x$ is 0. As another example, if the parity of the basis code vectors $b_{x,y}$ of the set of basis code vectors $b_x$ is −1, the signs of the values $b_{x,y,t}$ of the potential basis code vector may be assigned corresponding to the signs of the values of the input vector at the same position in the vector, respectively, and if there are not an odd number of negative components, the value $b_{x,y,t}$ in the potential basis code vector having the lowest non-null absolute value may change its sign. Or, as another example, if the parity of the basis code vectors $b_{x,y}$ of the set of basis code vectors $b_x$ is +1, the signs of the values $b_{x,y,t}$ of the potential basis code vector may be assigned corresponding to the signs of the values of the input vector at the same position in the vector, respectively, and if there are not an even number of negative components, the value $b_{x,y,t}$ in the potential basis code vector having the lowest non-null absolute value may change its sign.

As a non-limiting example, a code vector $c_{x,z,y}$ may be determined by $c_{x,z,y}=[b_{x,y,0}\cdot s_z, b_{x,y,1}\cdot s_z, \ldots, b_{x,y,n-1}\cdot s_z]$.

Each of the scale representatives $s_z$, wherein $z\in\{0, 1, \ldots S-1\}$ holds, is associated with at least one set of basis code vectors. For instance, as a non-limiting example this respective at least one set of basis code vectors may be represented by the set of basis code vectors $b_x$, with $x\in\{0, 1, \ldots n_z-1\}$, wherein $n_z$ may represent the number of sets of basis code vectors associated with the respective scale representative $s_z$, wherein $0<n_z<X$ holds. Based on this linkage between a respective scale representative $s_z$ and the associated at least one set of basis code vectors $b_x$, with $x\in\{0, 1, \ldots n_z-1\}$, the associated at least one set of code vectors $c_{x,z,y}$, with $x\in\{0, 1, \ldots n_z-1\}$ and $y\in\{0, 1, \ldots B_x-1\}$ and $z\in\{0, 1, \ldots S-1\}$), can be determined.

Thus, as an example, a codebook structure of the above mentioned codebook may be defined by the plurality of scale representatives $s_z$, the plurality of sets of basis code vectors $b_x$, and the linkage between each scale representative with the associated at least one set of basis code vectors.

Since at least one set of basis code vectors, e.g. at least the set of basis code vectors $b_0$, is associated with at least two scale representatives, the same set of basis code vectors can be used to construct code vectors of the at least one set of code vectors associated with a first scale representative and to construct code vectors of the at least one set of code vectors associated with at least one further scale representative.

It is possible to determine, for each set of basis code vectors of a plurality of sets of basis code vectors, a potential basis code vector for encoding an input vector in other ways.

For example determining a code vector for encoding the input vector from a subset of code vectors is based on a determined distortion metric or distance, or error value.

In such examples a scale representation of the plurality of scale representations is selected.

Furthermore the determined potential basis code vector of a set of basis code vectors associated with the selected scale representation is selected.

A code vector may then be determined based on the selected potential basis code vector and on the selected scale representation, wherein this determining of a code vector may be performed as described with respect to the method described herein.

In some examples based on the determined code vector and the input vector, a distortion metric is determined. For instance, said distortion metric may be based on any kind of suitable distance between the determined code vector and the input vector. As an example, a Hamming distance or an Euclidian distance or any other distance may be used. As an example, determining the code vector may be omitted and the distortion metric may be calculated by inherently considering the respective code vector associated with the selected scale representation and the set of basis code vectors associated with this selected scale representation.

For instance, if $c_{x,z,y}=[c_{x,z,y,0}, c_{x,z,1}, \ldots, c_{x,z,n-1}]$ represents the code vector determined in step 430 and $i=[i_0, i_1, \ldots, i_{n-1}]$ represents the input vector, a distance d may be calculated based on $$d=\sum_{k=0}^{n-1}(i_k-c_{x,z,y,k})^2.$$

This distance d according to the equation above may be replaced with distance d' calculated based on $$d'=\sum_{k=0}^{n-1}c_{x,z,y,k}^2-2\sum_{k=0}^{n-1}i_k\cdot c_{x,z,y,k}$$

Or, as another example, in case the distortion metric is determined based on a weighting function, distance d according to equation above may be amended as follows:

$$d_w=\sum_{k=0}^{n-1}w_k\cdot(i_k-c_{x,z,y,k})^2,$$

wherein $w_k$ represent weighting factors of the weighting function.

Accordingly, distance d' according to the equation above may by weighted by means of the weighting function in the following way:

$$d'_w=\sum_{k=0}^{n-1}w_k\cdot c_{x,z,y,k}^2-2\sum_{k=0}^{n-1}w_k\cdot i_k\cdot c_{x,z,y,k}$$

For instance, the distortion metric d, or d', or $d_w$, or $d_w'$ may be stored, if it is the first determined distortion metric, or it may be compared with a stored distortion metric, wherein the stored distortion metric is replaced if the newly determined distortion metric is better than the stored distortion metric. Furthermore, the code vector associated with the stored distortion metric may be stored or an identifier of this code vector may be stored.

Then for example the operation can checked whether there are any further sets of basis code vectors associated with the selected scale representation. If yes, then the determined potential basis code vector of this further set of basis code vectors associated with the selected scale representation is selected. If no there is a check made against further scale representation of the plurality of scale representations.

If there is a further scale representation of the plurality of scale representations, then the further scale representation is selected, otherwise the code vector associated with the best distance metric may be selected for encoding the input vector.

For instance, where the sets of basis code vectors may represent leader classes, wherein each leader class comprises a different leader vector and permutations of said leader vector. Thus, the leader vector and the permutations of said leader vector may represent the basis code vectors of the respective set of basis code vectors. As an example, a leader vector is an n-dimensional vector (with n denoting an integer number), whose (positive) components are ordered (e.g. decreasingly). The leader class corresponding to the leader vector then consists of the leader vector and all vectors obtained through all the signed permutations of the leader vector (with some possible restrictions).

A union of leader classes may be defined by the sets of basis code vectors associated with the same scale representation of the plurality of scale representations and the respective scale representation. For instance, a union of leader classes may be associated with a set of code vectors obtained by means of scaling the basis code vectors of the associated step of basis code vectors with the scale representative.

Such a union of leader classes may be considered as a truncation. Thus, if the plurality of scale representations are n scale representations, n unions of leader classes may be defined, wherein each union of leader class is defined by means of the respective scale representation and the sets of basis code vectors associated with the respective scale representation.

Accordingly, the plurality of scale representations and the plurality of sets of basis code vectors may define a plurality of union of leader classes thereby defining a codebook, wherein, as an example, each union of leader classes may be considered as a union of scaled leader classes.

Codebooks used within these speech and audio codecs may for instance be based on lattice structures, as described in reference "Multiple-scale leader-lattice VQ with application to LSF quantization" by A. Vasilache, B. Dumitrescu and I. Tabus, Signal Processing, 2002, vol. 82, pages 563-586, Elsevier, which is incorporated herein in its entirety by reference. For instance, a D10+ lattice may be considered for quantization, but any other well-suited lattice quantization may also be considered.

For instance the sets of basis code vectors are leader classes, wherein each leader class comprises a different leader vector and permutations of said leader vector, and wherein each leader vector represents an n-dimensional vector comprising n absolute values arranged in a descending or an ascending order.

The leader vector l of the respective set of basis code vectors $b_x$ may be represented by $l=[l_0, l_1, \ldots, l_{n-1}]$, wherein $l_0, l_1, \ldots, l_{n-1}$ are absolute values. In case of a descending order $l_0$ represents the 1-highest value, $l_1$ represents the 2-highest value and $l_{n-1}$ represents the n-highest value. In case of an ascending order $l_0$ represents the 1-lowest value, $l_1$ represents the 2-lowest value and $l_{n-1}$, represents the n-lowest value.

The value $l_{k-1}$ of the respective leader vector, which represents the value at kth position in the respective leader vector, can be assigned to a position in the potential basis code vector which corresponds to the position of the k-highest absolute value (in case of a descending ordered leader vector) or to the position of the k-lowest absolute value (in case of an ascending ordered leader vector) in the input vector. For instance, this position may be denoted as position m. As an example, the potential basis code vector may be represented by $p=[p_0, p_1, \ldots, p_{n-1}]$.

For instance, as a non-limiting example, an exemplary input vector may be $i=[-2.4, 5.0, -1.3, 0.2]$, wherein the corresponding absolute valued input vector may be $ia=[2.4, 5.0, 1.3, 0.2]$.

In case of the descending order of the leader vector, the value in position k of the leader vector, i.e. value $l_{k-1}$, is assigned to a position in the potential basis code vector which corresponds to the position of the k-highest absolute value in the input vector. For instance, starting with the first position represented by counter k=1, the position of the 1-highest absolute value in the input vector is position m=2, since value 5.0 is the 1-highest value in the absolute valued input vector and is located in position m=2, i.e. $ia_1$. Accordingly, value $l_0$ is assigned to the position m=2 in the potential basis code vector, i.e. $p_1=l_0$ may hold.

Furthermore, the sign (+ or −) of the assigned value in the potential basis code vector $p_{m-1}$ is set in accordance with the sign of the value of the input vector associated with the k-highest absolute value. Accordingly, $$p_{m-1}=l_{k-1}\cdot\mathrm{sign}(i_{m-1})$$

may hold.

Thus, in the non-limiting example of an exemplary input vector $i=[-2.4, 5.0, -1.3, 0.2]$, $p_1=l_0$ may hold since value $i_1=5.0$ has a positive sign.

The position counter k may be incremented, and it may be checked whether there is another value in the leader vector, i.e. whether $k\leq n$ holds.

If yes, the method proceeds and in the non-limiting example, with respect to position k=2, value 2.4 at position m=1 represents the 2-highest (k-highest) absolute value in the input vector. Thus, $$P_0=l_1\cdot\mathrm{sign}(i_0)=-l_1$$

may hold for assigning $l_1$ with the respective sign, since value $i_0=-2.4$ in the input vector has a negative sign.

In this way, for the non-limiting example, the loop may iterate through the positions of the leader vector in the following way:

$$k=3\rightarrow m=3\rightarrow P_2=l_2\cdot\mathrm{sign}(i_2)=-l_2;\text{ and}$$

$$k=4\rightarrow m=4\rightarrow P_3=l_3\cdot\mathrm{sign}(i_3)=+l_3$$

Accordingly, the respective potential code vector obtained by the example method may result in $p=[-l_1, l_0, -l_2, l_3]$ in case of the descending ordered respective leader vector l.

If the leader vector l is ordered in an ascending way, then the method described above may be performed with m representing the position of the k-lowest value in the absolute valued input vector, wherein $p_{m-1}=l_{k-1}\cdot\mathrm{sign}(i_{m-1})$ may hold.

The obtained potential code vector p is associated with the respective set of basis code vectors $b_x$, wherein l represents the leader vector of this respective set of basis code vectors. For instance, with respect to the example process of determining a code vector based on a basis code vector $b_{x,y,t}$ and scale representative $s_z$ and described above, the potential code vector p represents the nearest basis code vector $b_{x,y}$ of the set of basis code vectors $b_x$ with respect to the input vector, wherein the absolute valued input vector is used for determining the potential code vector of a respective set of basis code vectors and wherein the sign of each value $b_{x,y,k-1}$ at the kth position of the determined nearest basis code vector $b_{x,y}$ is assigned with the sign of the respective value $i_k$ at the kth position of the input vector i, wherein $0<k\leq n$ holds.

Thus, this nearest basis code vector $b_{x,y}$ representing the potential code vector p can be used for determining a code vector $c_{x,z,y}$ based on the nearest basis code vector $b_{x,y}$ and based on a respective scale representative $s_z$, as described above.

To each truncation a different scale representative is assigned (e.g. through training), e.g.:
float scale□={0.8, 1.2, 2.7};

Accordingly, for instance, a first set of code vectors of a plurality of code vectors of the codebook is defined by the first truncation scaled by the first scale representation 0.8, a second set of code vectors of the plurality of code vectors of the codebook is defined by the second truncation scaled by the second scale representation 1.2, and a third set of code vectors of the plurality of code vectors of the codebook is defined by the third truncation scaled by the third scale representation 2.7, the codebook having a multiple scale lattice structure.

As an example, the search in the multiple scale lattice structure may be seen as having two phases: the first one may compute a potential code vector for each leader class, i.e. for each set of basis code vectors, and the second one may calculate the distortion only for the potential codevectors.

For instance, an absolute value function may be applied to the input vector i such that absolute input vector ia comprises the absolute values of the vector i, and then the absolute input vector may be sorted in an descending (or, alternatively, in an ascending) order.

As an example, an index representation may contain representatives indicating the indexes of each input vector i in the descendingly (or ascendingly) ordered absolute valued vector. For instance, said index representation may be an integer array 'indx'.

For example, if the input vector is [−2.4 5.0 −1.3 0.2], the absolute valued vector is [2.4 5.0 1.3 0.2] and the 'indx' array is [1 0 2 3]. Since the leader vectors may be descendingly ordered, during the nearest neighbour search algorithm, the first value of the leader vector may be assigned on the position corresponding to the highest absolute value component of the input vector and so on.

In the following non-limiting example, 'idx_lead_max' is the maximum number of leader classes out of all truncations, which may correspond to X, in this example may be is 9. Accordingly 9 sets of basis code vectors are defined by means of the 9 leader classer, wherein the nth leader class is defined by &pl[n−1].

For instance, the array 'sign' may store the signs of the input vector components.

```
/* First part of the search: compute all potential codevectors */
    pl_crt = &pl[0]; /* pl contains the leader vectors */
    for (u=0;u<idx_lead_max;u++)
    {
        for(j=0;j<LATTICE_DIM;j++, pl_crt++)
        {
            j_crt = indx[j];
            if ( (*pl_crt) > 0. )
            {
                cv_pot[u][j_crt] = (*pl_crt)*(float)sign[j_crt];
            }
            else
            {
                cv_pot[u][j_crt] = 0.0f;
            }
        }
    }
```

The outer loop defined by counter u may be considered to associate each u with a respective leader vector. Thus, in accordance with counter u, a corresponding set of basis code vectors is selected by means of the outer loop, since each leader vector corresponds to a different set of basis code vectors of the plurality of basis code vectors.

The inner loop defined by integer value j may be considered to determining a potential basis code vector associated with the selected set of basis code vectors, j_crt indicating the position of the (j+1)highest absolute value in the input vector.

Thus, the different potential basis code vectors cv_pot are determined by means of this exemplary first part of the search.

The second part of the search may be used for determining a code vector for encoding the input vector from a subset of code vectors.

```
/* Second part of the search */
for(l=0;l<no_scales;l++)
{
    s = scale[l];
    s2 = s*s;
    for(k=0;k<LATTICE_DIM;k++)
    {
        ws1[k] = w[k]*s*2.0f*in[k];
        ws2[k] = w[k]*s2;
    }
    for(j=0;j<no_leaders[l];j++)
    {
        tmp_dist = 0.0f;
        for(k=0;k<LATTICE_DIM;k++)
        {
            s = cv_pot[j][k];
            tmp_dist += (ws2[k]*s−ws1[k])*s;
        }
        if (tmp_dist < min_dist)
        {
            min_dist = tmp_dist;
            best_scale = l;
            best_idx = k;
        }
    }
}
```

The outer loop may be defined by counter l, wherein l is issued to select one scale representation scale[l] of the plurality of scale representations.

LATTICE_DIM defines the length of the code vectors which may correspond to the length of the input vector to be encoded.

Afterwards, the values ws1[k] and ws2[k] for each k in (0, . . . , LATTICE_DIM) are calculated, which may be considered to be that part of the distortion metric (X3) which is independent of potential basis code vector. The value w[k] represents the value of the weighting function for each k.

The example code shown above further has an inner j loop "for(j=0;j<no_leaders[l];j++)", wherein no_leaders[l] defines the set of leader vectors associated with the selected scale representative scale[l], i.e. no_leaders[l] may correspond to $n_2$ representing the number of sets of basis code vectors associated with the respective scale representative scale[l], and thus this loop iterates through each set of leader vectors associated with the selected scale representative scale[l], wherein for leader vector of this set of leader vectors one potential basis code vector cv_pot has been determined. Thus, for instance, this loop iteratively selects each potential basis code vector cv_pot the set of basis code vectors associated with the selected scale representation, wherein cv_pot[j] may represent the respective jth basis code vector of this set of basis code vectors.

For each of these basis code vectors and the selected scale representative, the respective distortion metric for the code vector being associated with the respective basis code vector and the selected scale representative may be determined, e.g. based on distortion metric in the following way:

$$d = \sum_{k=0}^{n-1} (ws2[k] \cdot \text{cv_pot}[j][k] - ws1[k]) \cdot \text{cv_pot}[j][k]$$

The distortion metric having the lowest value is determined to represent the best distortion metric, wherein the code vector associated with this distortion metric code vector may be used for encoding the input vector. For instance, this code vector may be defined by the best scale representative and the best potential basis code vector of the set of potential basis code vectors.

The embodiments described herein reduce the complexity of the vector quantization by not computing the potential codevector array cv_pot, but employing the absolute value sorted version of the input vector and determining or generating the distortion calculation in a suitable transposed space.

In some embodiments the lattice vector quantizer comprises as input vector sorter 402. The input vector sorter 402 or suitable means for sorting the input vector can be configured to receive the input vector.

The operation of receiving the input vector is shown in FIG. 6 by step 501.

The lattice vector quantizer and input vector sorter 402 is configured to sort the input vector into an absolute value descending order (it would be understood that in some embodiments the sorting can be performed in an absolute value ascending order with suitable changes to the following operations).

Thus for example if the input vector is l=[−2.4 5.0 −1.3 0.2], the absolute valued vector is absi=[2.4 5.0 1.3 0.2], the sorted absolute valued vector which is defined here as cv_pot1=[5.0 2.4 1.3 0.2]

and the sorting permutation 'indx'=[1 0 2 3].

The sorting of the input vector is shown in FIG. 6 by step 503.

The input vector sorter can then pass the sorted vector and sorting permutation to the code vector determiner 403.

In some embodiments the lattice vector quantizer 453 comprises a potential code vector determiner 401. The potential code vector determiner or suitable means for determining a potential code vector is configured to store or generate the leader classes used to generate the codevectors.

For instance the leader classes may be defined as (in Q1 value, in other words multiplied by 2)

```
const Word16 pl_fx[ ] =          // Q1 vectors in first layers
{2, 2, 0, 0, 0, 0, 0, 0,
 1, 1, 1, 1, 1, 1, 1, 1,
 2, 2, 2, 2, 0, 0, 0, 0,
 4, 0, 0, 0, 0, 0, 0, 0,
 3, 1, 1, 1, 1, 1, 1, 1,         // 5
 2, 2, 2, 2, 2, 2, 0, 0,
 4, 2, 2, 0, 0, 0, 0, 0,
 3, 3, 1, 1, 1, 1, 1, 1,
 2, 2, 2, 2, 2, 2, 2, 2,
 4, 2, 2, 2, 2, 0, 0, 0,         // 10
 4, 4, 0, 0, 0, 0, 0, 0,
 3, 3, 3, 1, 1, 1, 1, 1,
 5, 1, 1, 1, 1, 1, 1, 1,
 4, 2, 2, 2, 2, 2, 2, 0,
 4, 4, 2, 2, 0, 0, 0, 0,         // 15
 6, 2, 0, 0, 0, 0, 0, 0,
 3, 3, 3, 3, 1, 1, 1, 1,
 5, 3, 1, 1, 1, 1, 1, 1,
 4, 4, 2, 2, 2, 2, 0, 0,
 4, 4, 4, 0, 0, 0, 0, 0,         // 20
 6, 2, 2, 2, 0, 0, 0, 0,
 3, 3, 3, 3, 3, 1, 1, 1,
 5, 3, 3, 1, 1, 1, 1, 1,
 4, 4, 2, 2, 2, 2, 2, 2,
 4, 4, 4, 2, 2, 0, 0, 0,         // 25
 6, 2, 2, 2, 2, 2, 0, 0,
 6, 4, 2, 0, 0, 0, 0, 0,
 3, 3, 3, 3, 3, 3, 1, 1,
 5, 3, 3, 3, 1, 1, 1, 1,
 5, 5, 1, 1, 1, 1, 1, 1,         // 30
 7, 1, 1, 1, 1, 1, 1, 1,
 4, 4, 4, 2, 2, 2, 2, 0,
 4, 4, 4, 4, 0, 0, 0, 0,
 6, 2, 2, 2, 2, 2, 2, 2,
 6, 4, 2, 2, 2, 0, 0, 0,};
```

These leader classes can in some embodiments be passed to the code vector determiner 403.

In some embodiments the lattice vector quantizer 453 comprises a code vector determiner 403. The code vector determiner 403 or suitable means for determining a code vector can in some embodiments receive the leader classes and also the sorted input vector and permutation vector. The code vector determiner can then from these values determine the output code vector associated with the input vector.

Where the distance to be determined is a weighted Euclidean distance then in some embodiments the weights are transposed according to the permutation vector and an intermediary input vector produce is generated. It would be understood that in some embodiments the weights are uniform or the weighting operation is optional where the unweighted Euclidean distance is employed.

An example of this can be shown by the following code

/* calculate intermediary product between transposed weights and sorted input vector */

```
for(j=0;j<LATTICE_DIM;j++)
{
    w_transp[j] = w[indx[j]];
    wx[j] = w_transp[j]*cv_pot[j];
}
```

The operation of transposing and applying weights to generate an intermediary product based on the sorted input vector and the transposed weights is shown in FIG. 6 by step 505

In some embodiments the code vector determiner can determine distance components sum1 and sum2 for a first scale value scale[0].

This operation can be divided into the steps of:

Firstly, initialising the scale and square of the scale values for a first scale value scale[0].

The operation of initialising the scale and square of the scale values are shown in FIG. 6 by step 506.

Secondly, selecting a leader vector from the leader classes matrix. This is shown in the above matrix example as the matrix pl_crt.

The operation of selecting a leader vector is shown in FIG. 6 by step 507.

Thirdly generating intermediary distance values sum1 and sum2 based on Intermediary values and the selected leader vector.

The operation of generating intermediary distance values based on the selected leader vector is shown in FIG. 6 by step 509.

Fourthly, checking the parity conditions where the leader vector does not reach the $7^{th}$ position and correcting the sum1 value where the number of minus signs in the input vector differ from the constraint given in the leader class parity.

The operation of checking the parity conditions where the leader vector does not reach the $7^{th}$ position and correcting the sum1 value where the number of minus signs in the input vector differ from the constraint given in the leader class parity is shown in FIG. 6 by step 511.

Fifthly, determining the distance or error value from the sum1 and sum 2 values and then where the current leader vector distance is the smallest indicating the index of the smallest vector.

The operation of determining the distance for the leader vectors is shown in FIG. 6 by step 513.

The operation can then loop round until all of the leader vectors have been selected.

The operation of checking whether all leader vectors have been selected and looping back where not all of the leader vectors have been selected is shown in FIG. 6 step 514.

These steps can be shown in the following code

```
for(j=0;j<no_leaders[0];j++)
{
    sum1[j] = 0;
    sum2[j] = 0;
    l = 0;
```

-continued

```
    while(l<LATTICE_DIM−1)
    {
        p = *pl_crt;
        if (p)
        {
            sum1[j] = sum1[j] + wx[l] * p;
            sum2[j] = sum2[j] + w_transp[j]*p*p;
            pl_crt++;
            l++;
        }
        else
        {
            pl_crt += LATTICE_DIM−1;
            l = LATTICE_DIM;
        }
    }
    if (1 − LATTICE_DIM+ 1 ==0)
    (/* if it went up to 7th position, some leaders
have zeros at the end, so no need for them to check the
parity, because they have null-parity */
    p = *pl_crt;
    if ( pl_par_fx[j] ) /* if non-zero parity */
        {
            if ( sig −pl_par_fx[j] != 0 ) /* if number
of minus signs in the input vector different from the
constraint given by the leader class parity */
        {
        sum1[j] = sum1[j] − wx[l]* p; /* here is
subtraction */
        sum2[j] * sum2[j] + w_transp[l] *p*p;
        pl_crt++;
            }
        else
    {
        sum1[j] = sum1[j] + wx[l] * p;
        sum2[j] = sum2[j] + w_transp[l]*p*p;
        pl_crt++;
        }
    }
    else
    {
        sum1[j] = sum1[j] + wx[l]* p;
        sum2[j] = sum2[j] + w_transp[l] *p*p;
        pl_crt++;
        }
    }
    tmp_dist = sum2[j]*s2 −sum1[j]*s;
    if (tmp_dist < min_dist )
    {
        min_dist = tmp_dist;
        best_idx = j;
    }
}   /* end of j loop */
```

Then in some embodiments the code vector determiner can be configured to use the sum1 and sum2 values to determine distortion distances for other scales. A similar operation of checking for a 'best' scale value is further made.

The operation of determining distortion distances for other scales is shown in FIG. 6 by step 515.

The operation of determining the distortion distance can for the other scales using the sum1 and sum2 values can be implemented using the following example code

```
for(k=l;k<no_scales;k++)
{
    s = scale[k];
    s2 = s*s;
    /* and now use the sum1, sum2 values calculated above
to calculate distortion for the other scales */
```

-continued

```
        for(j=0;j<no_leaders[j];j++)
        {
            tmp_dist = sum2[j]*s2 −sum1[j]*s;
            if (tmp_dist < min_dist )
            {
                min_dist = tmp_dist;
                best_scale = k;
                best_idx = j;
            }
        }
    }
```

Furthermore in some embodiments the code vector determiner can be configured, once the best leader class and best scale are found, to calculated the resulting codevector 'cv_out'.

The operation of performing a reverse transpose to calculate the codevector is shown in FIG. 6 by step 517.

In some embodiments the operation of calculating the codevector can be implemented by the following example code.

```
    /* inverse permutation */
    for(j=0;j<LATTICE_DIM;j++)
    {
        id[indx[j]] = j;
    }
    for(j=0;j<LATTICE_DIM;j++)
    {
      cv_out[j] = sign[j]
  *pl_fx[best_idx*LATTICE_DIM+id[j]]);
    }
    if(pl_par_fx[best_idx] )
    {
      if ( sig −pl_par_fx[best_idx] != 0 )
      {
            cv_out[smallest] = −cv_out[smallest];
      }
    }
```

In some embodiments the calculation of the variables sum1 and sum2 is done up to the number of leaders from the first truncation (no_leaders[0]), meaning that the number of leaders should be decreasingly ordered and their corresponding scales ordered accordingly.

In such embodiments an additional complexity reduction is produced because the maximum number of leaders for one structure need not be computed, but it is known to be on the first position.

It would be understood that most of the complexity reduction comes from the fact that only the winning leader vector has to be transposed, not all of them. The calculation is done on positive values (both leader vector and input vector are in absolute values) which is ok as long as the input vector component and the quantized one have the same sign.

A difference in sign intervenes when there is a parity constraint (odd or even number of negative components) in the considered leader vector and this constraint is not respected by the input vector. In this case the sign of quantized value of the smallest input vector components has its sign flipped. The smallest input vector component corresponds to the last component in the transposed space. This is why the first loop for calculating sum1 and sum2 is "while(l<LATTICE_DIM−1)". In the real, non-transposed space this corresponds to smallest=indx[LATTICE_DIM−1]. LATTICE_DIM is the dimension of the considered lattice.

Although the above examples describe embodiments of the application operating within a codec within an apparatus 10, it would be appreciated that the invention as described below may be implemented as part of any audio (or speech) codec, including any variable rate/adaptive rate audio (or speech) codec. Thus, for example, embodiments of the application may be implemented in an audio codec which may implement audio coding over fixed or wired communication paths.

Thus user equipment may comprise an audio codec such as those described in embodiments of the application above.

It shall be appreciated that the term user equipment is intended to cover any suitable type of wireless user equipment, such as mobile telephones, portable data processing devices or portable web browsers.

Furthermore elements of a public land mobile network (PLMN) may also comprise audio codecs as described above.

In general, the various embodiments of the application may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the application may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this application may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the application may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules.

Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analogue and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method for execution by an audio encoder, the method comprising:

generating at least one vector of parameters defining at least one audio signal by dividing the at least one audio signal into time frames and determining a vector of line spectral frequency parameters associated with the time frames of the at least one audio signal;

sorting components of the at least one vector of parameters according to a descending order based on absolute values of the components of the at least one vector of parameters to generate an associated at least one ordered vector of parameters;

selecting from a list of leader classes at least one potential code vector;

determining a distance between the at least one potential code vector and the at least one ordered vector of parameters by generating a first and second distance components based on a first scale value, the first and second distance components associated with the distance between the at least one potential code vector and the at least one ordered vector of parameters, correcting the sign of the first distance component where the at least one potential code vector fails a parity constraint test, and determining a distance between the at least one potential code vector and the at least one ordered vector of parameters based on the first and second distance components;

determining at least one leader class associated with a potential code vector which generates the smallest associated distance;

transposing the at least one leader class to generate an output lattice quantized codevector; and encoding the at least one audio signal with the audio encoder to produce the output lattice quantize codevector.

2. The method as claimed in claim 1, further comprising:

selecting at least one scale factor;

wherein determining a distance between the at least one potential code vector and the at least one ordered vector of parameters further comprises determining a distance based on the at least one scale factor;

wherein determining at least one leader class associated with a potential code vector which generates the smallest associated distance further comprises determining an output scale factor associated with the potential code vector and scale factor which generates the smallest associated distance; and wherein transposing the at least one leader class to generate an output lattice quantized codevector comprises applying the output scale factor to the output lattice quantized codevector.

3. The method as claimed in claim 1, wherein sorting components of the at least one vector of parameters comprises:

determining weights for a weighted distance determination;

sorting the weights based on the descending order based on the absolute values of the components of the at least one vector of parameters to generate a sorted weight vector; and applying the sorted weight vector to the at least one ordered vector of parameters.

4. The method as claimed in claim 1, wherein determining a distance between the at least one potential code vector and the at least one ordered vector of parameters further comprises determining a distance between the at least one potential code vector and the at least one ordered vector of parameters based on the first and second distance components and further scale values.

5. The method as claimed in claim 1, wherein determining at least one leader class associated with a potential code vector which generates the smallest associated distance comprises:

determining an index of the potential code vector which generates the smallest associated distance; and determining a scale value of the potential code vector which generates the smallest associated distance by applying scale values to only the potential code vector which generates the smallest associated distance.

6. The method as claimed in claim 1, wherein transposing the at least one leader class to generate an output lattice quantized codevector comprises sorting the at least one leader class by the reverse ordering of at least one vector of absolute tuples.

7. An apparatus of an audio encoder comprising at least one processor and at least one memory including computer program code, the at least one memory and the computer program code configured to, with the at least one processor, cause the apparatus at least to:

generate at least one vector of parameters defining at least one audio signal by dividing the at least one audio signal into time frames and determining a vector of line spectral frequency parameters associated with the time frames of the at least one audio signal;

sort components of the at least one vector of parameters according to a descending order based on absolute values of the components of the at least one vector of parameters to generate an associated at least one ordered vector of parameters;

select from a list of leader classes at least one potential code vector;

determine a distance between the at least one potential code vector and the at least one ordered vector of parameters by generating a first and second distance components based on a first scale value, the first and second distance components associated with the distance between the at least one potential code vector and the at least one ordered vector of parameters, correcting the sign of the first distance component where the at least one potential code vector fails a parity constraint test, and determining a distance between the at least one potential code vector and the at least one ordered vector of parameters based on the first and second distance components;

determine at least one leader class associated with a potential code vector which generates the smallest associated distance;

transpose the at least one leader class to generate an output lattice quantized codevector; and encode the at least one audio signal with the audio encoder to produce the output lattice quantize codevector.

8. The apparatus as claimed in claim 7, further caused to:

select at least one scale factor;

wherein determining a distance between the at least one potential code vector and the at least one ordered vector of parameters further causes the apparatus to determine a distance based on the at least one scale factor;

wherein determining at least one leader class associated with a potential code vector which generates the smallest associated distance further causes the apparatus to determine an output scale factor associated with the potential code vector and scale factor which generates the smallest associated distance; and wherein transposing the at least one leader class to generate an output lattice quantized codevector causes the apparatus to apply the output scale factor to the output lattice quantized codevector.

9. The apparatus as claimed in claim 7, wherein the apparatus caused to sort components of the at least one vector of parameters is caused to:

determine weights for a weighted distance determination;

sort the weights based on the descending order based on absolute values of the components of the at least one vector of parameters to generate a sorted weight vector; and apply the sorted weight vector to the at least one ordered vector of parameters.

10. The apparatus as claimed in claim 7, wherein the apparatus caused to determine a distance between the at least one potential code vector and the at least one ordered vector of parameters is further caused to determine a distance between the at least one potential code vector and the at least one ordered vector of parameters based on the first and second distance components and further scale values.

11. The apparatus as claimed in claim 7, wherein the apparatus caused to determine at least one leader class associated with a potential code vector which generates the smallest associated distance is caused to:

determine an index of the potential code vector which generates the smallest associated distance; and determine a scale value of the potential code vector which generates the smallest associated distance by applying scale values to only the potential code vector which generates the smallest associated distance.

12. The apparatus as claimed in claim 7, wherein the apparatus caused to transpose the at least one leader class to generate an output lattice quantized codevector causes the apparatus to sort the at least one leader class by the reverse ordering of at least one vector of absolute tuples.

13. A computer program product comprising at least one tangible computer readable storage medium, the computer readable storage medium comprising a set of instructions which, when executed by one or more processors, causes an audio encoder to:

generate at least one vector of parameters defining at least one audio signal by dividing the at least one audio signal into time frames and determining a vector of line spectral frequency parameters associated with the time frames of the at least one audio signal;

sort components of the at least one vector of parameters according to a descending order based on absolute values of the components of the at least one vector of parameters to generate an associated at least one ordered vector of parameters;

select from a list of leader classes at least one potential code vector;

determine a distance between the at least one potential code vector and the at least one ordered vector of parameters by generating a first and second distance components based on a first scale value, the first and second distance components associated with the distance between the at least one potential code vector and the at least one ordered vector of parameters, correcting the sign of the first distance component where the at least one potential code vector fails a parity constraint test, and determining a distance between the at least one potential code vector and the at least one ordered vector of parameters based on the first and second distance components;

determine at least one leader class associated with a potential code vector which generates the smallest associated distance;

transpose the at least one leader class to generate an output lattice quantized codevector; and encode the at least one audio signal with the audio encoder to produce the output lattice quantize codevector.

14. The computer program product as claimed in claim 13, further causes the apparatus to:

select at least one scale factor;

wherein determining a distance between the at least one potential code vector and the at least one ordered vector of parameters further causes the apparatus to determine a distance based on the at least one scale factor;

wherein determining at least one leader class associated with a potential code vector which generates the smallest associated distance further causes the apparatus to determine an output scale factor associated with the potential code vector and scale factor which generates the smallest associated distance; and wherein transposing the at least one leader class to generate an output lattice quantized codevector causes the apparatus to apply the output scale factor to the output lattice quantized codevector.

15. The computer program product as claimed in claim 13, wherein the computer program product which causes the apparatus to sort components of the at least one vector of parameters causes the apparatus to:

determine weights for a weighted distance determination;

sort the weights based on the descending order based on absolute values of the components of the at least one vector of parameters to generate a sorted weight vector; and apply the sorted weight vector to the at least one ordered vector of parameters.

* * * * *